US005605874A

United States Patent [19]

Taylor et al.

[11] Patent Number: 5,605,874

[45] Date of Patent: Feb. 25, 1997

[54] PRESSURE-SENSITIVE COPYING MATERIAL

[75] Inventors: David J. Taylor, Monks Risborough; Ivan Sheiham, Marlow; Margaret P. Templey, Thame, all of England

[73] Assignee: The Wiggins Teape Group Limited, United Kingdom

[21] Appl. No.: 504,766

[22] Filed: Jul. 20, 1995

[30] Foreign Application Priority Data

Jul. 20, 1994 [GB] United Kingdom ..... 9414637

[51] Int. Cl.[6] ..... B41M 5/12

[52] U.S. Cl. ..... 503/201; 427/150; 427/151; 503/200; 503/213; 503/215; 503/218

[58] Field of Search ..... 503/213, 218, 503/215, 200, 201; 427/150, 151

[56] References Cited

U.S. PATENT DOCUMENTS

| | | | |
|---|---|---|---|
| 2,712,507 | 7/1955 | Green | 117/36 |
| 2,730,457 | 1/1956 | Green et al. | 117/36 |
| 2,800,457 | 7/1957 | Green et al. | 252/316 |
| 2,800,458 | 7/1957 | Green et al. | 252/316 |
| 3,016,308 | 1/1962 | Macaulay | 117/36.7 |
| 3,041,289 | 6/1962 | Katchen et al. | 252/316 |
| 3,753,761 | 8/1973 | Sugahara et al. | 117/36.2 |
| 4,001,140 | 1/1977 | Foris et al. | 252/316 |
| 4,027,065 | 5/1977 | Brockett et al. | 428/307 |
| 4,070,508 | 1/1978 | Ishige et al. | 427/282 |
| 4,100,103 | 7/1978 | Foris et al. | 252/316 |
| 4,105,823 | 8/1978 | Hasler et al. | 428/307 |
| 4,335,013 | 6/1982 | Allart et al. | 252/364 |
| 4,387,117 | 6/1983 | Shanton | 427/150 |
| 4,391,850 | 7/1983 | Shanton | 427/150 |
| 4,396,670 | 8/1983 | Sinclair | 428/321.5 |
| 4,405,371 | 9/1983 | Sugahara et al. | 106/21 |
| 4,629,800 | 12/1986 | Yonese et al. | 549/226 |
| 4,783,196 | 11/1988 | Eckstein et al. | 8/527 |
| 4,831,141 | 5/1989 | Berneth et al. | 544/90 |
| 4,835,270 | 5/1989 | Berneth | 544/73 |
| 4,859,650 | 8/1989 | Hilterhaus et al. | 503/213 |
| 4,923,641 | 5/1990 | Eckstein et al. | 544/86 |
| 5,084,433 | 1/1992 | Kraft | 503/201 |
| 5,178,949 | 1/1993 | Sakamoto et al. | 428/402.2 |
| 5,209,947 | 5/1993 | Taylor et al. | 427/150 |
| 5,281,266 | 1/1994 | Sheiham et al. | 106/311 |
| 5,304,242 | 4/1994 | Taylor | 106/483 |
| 5,342,556 | 8/1994 | Trauebel et al. | 264/4.7 |

FOREIGN PATENT DOCUMENTS

| | | | |
|---|---|---|---|
| 24898 | 3/1981 | European Pat. Off. | 503/213 |
| 24897 | 3/1981 | European Pat. Off. | 503/213 |
| 86636 | 8/1983 | European Pat. Off. | 503/213 |
| 144472 | 6/1985 | European Pat. Off. | 503/225 |
| 247816 | 12/1987 | European Pat. Off. | 503/213 |
| 276980A | 8/1988 | European Pat. Off. | 503/221 |
| 573210 | 12/1993 | European Pat. Off. | 503/213 |
| 593192A | 4/1994 | European Pat. Off. | 503/213 |
| 1769933 | 3/1972 | Germany | 503/215 |
| 2423830 | 12/1974 | Germany | 503/215 |
| 49/31414 | 3/1974 | Japan | 503/213 |
| 51/080685 | 7/1976 | Japan | 503/213 |
| 04/253779 | 9/1992 | Japan | 503/215 |
| 05/050746 | 8/1993 | Japan | 503/213 |
| 74/3090 | 5/1974 | South Africa | 503/215 |
| 1182743 | 3/1970 | United Kingdom | 503/221 |
| 1192938 | 5/1970 | United Kingdom | 503/221 |
| 1221489 | 2/1971 | United Kingdom | 503/215 |
| 1221571 | 2/1971 | United Kingdom | 503/215 |
| 1222016 | 2/1971 | United Kingdom | 503/215 |
| 1269601 | 4/1972 | United Kingdom | 503/221 |
| 1335762 | 10/1973 | United Kingdom | 503/221 |
| 1339968 | 12/1973 | United Kingdom | 503/221 |
| 1374049 | 11/1974 | United Kingdom | 503/221 |
| 1459417 | 12/1976 | United Kingdom | 503/221 |
| 1463815 | 2/1977 | United Kingdom | 503/221 |
| 1478596 | 7/1977 | United Kingdom | 503/221 |
| 1526353 | 9/1978 | United Kingdom | 503/213 |
| 2002801B | 2/1982 | United Kingdom | 503/221 |
| 2143247 | 4/1985 | United Kingdom | 503/212 |
| WO95/07188 | 3/1995 | WIPO | 503/213 |
| WO95/07187 | 3/1995 | WIPO | 503/213 |

*Primary Examiner*—B. Hamilton Hess
*Attorney, Agent, or Firm*—Burns, Doane, Swecker & Mathis, L.L.P.

[57] ABSTRACT

Pressure-sensitive copying material comprises 3,1 benzoxazine chromogenic material(s) in a solvent comprising vegetable oil and/or a mono-, di or tri-functional ester of a non-aromatic mono-carboxylic acid having a straight or branched hydrocarbon chain with at least three carbon atoms in the chain in addition to the carboxyl carbon atom and an inorganic colour developer. The surface pH of the colour developer is not more than about 8.7, which gives rise to enhanced image intensity and fade resistance compared with the use of 3,1 benzoxazine chromogenic materials in the same solvent with the same colour developer at higher surface pH values.

15 Claims, No Drawings

PRESSURE-SENSITIVE COPYING MATERIAL

This invention relates to pressure-sensitive copying material, particularly carbonless copying paper.

Pressure-sensitive copying material is well-known and is widely used in the production of business forms sets. Various types of pressure-sensitive copying material are known, of which the most widely used is the transfer type. A business forms set using the transfer type of pressure-sensitive copying material comprises an upper sheet (usually known as a "CB" sheet) coated on its lower surface with microcapsules containing a solution in an oil solvent or solvent composition of at least one chromogenic material (alternatively termed a colour former) and a lower sheet (usually known as a "CF" sheet) coated on its upper surface with a colour developer composition. If more than one copy is required, one or more intermediate sheets (usually known as "CFB" sheets) are provided, each of which is coated on its lower surface with microcapsules and on its upper surface with colour developer composition. Imaging pressure exerted on the sheets by writing, typing or impact printing (e.g. dot matrix or daisy-wheel printing) ruptures the microcapsules, thereby releasing or transferring chromogenic material solution on to the colour developer composition and giving rise to a chemical reaction which develops the colour of the chromogenic material and so produces a copy image.

In a variant of the above-described arrangement, the solution of chromogenic material may be present as isolated droplets in a continuous pressure-rupturable matrix instead of being contained within discrete pressure-rupturable microcapsules.

In another type of pressure-sensitive copying system, usually known as a self-contained or autogenous system, microcapsules and colour developing co-reactant material are coated onto the same surface of a sheet, and writing or typing on a sheet placed above the thus-coated sheet causes the microcapsules to rupture and release the solution of chromogenic material, which then reacts with the colour developing material on the sheet to produce a coloured image.

The solvents used to dissolve the chromogenic materials in pressure-sensitive copying materials as described above have typically been hydrocarbon products derived from petroleum or coal deposits, for example partially hydrogenated terphenyls, alkyl naphthalenes, diarylmethane derivatives, or dibenzyl benzene derivatives or derivatives of hydrocarbon products, for example chlorinated paraffins. These "prime solvents" are usually mixed with cheaper diluents or extenders such as kerosene, which although of lesser solvating power, give rise to more cost-effective solvent compositions.

Vegetable oils have long been recognised as possible alternatives to petrochemical-based solvents in pressure-sensitive copying materials, see for example U.S. Pat. No. 2,712,507 (column 3, lines 55 and 56); U.S. Pat. No. 2,730,457 (column 5, lines 30 and 31); and U.S. Pat. No. 3,016,308 (column 6, Table 1). Despite the age of these disclosures, it is only fairly recently that the use of such oils has been commercialized, to the best of our knowledge. The increased interest in vegetable oil solvents in recent years is reflected in the patent literature, see for example European Patent Applications Nos. 262569A; 520639A; and 573210A.

In commercial production of pressure-sensitive copying material, it has been conventional to use a mixture of different chromogenic materials in order to achieve a copy image which, inter alia, develops rapidly, retains its intensity over time (i.e. is not destroyed by fading), has a particular desired hue and is photocopiable. The most commonly used chromogenic materials are phthalides, particularly crystal violet lactone (CVL), and fluorans, particularly 3,7-di-N-substituted fluorans i.e. fluorans which are substituted at the 3- and 7- positions on the fluoran ring structure with substituted amino or N- heterocyclic groups (the 3- and 7-positions just referred to are often referred to as the 2- and 6- positions in an alternative widely used fluoran ring numbering system).

Such 3,7-di-N- substituted fluorans have the advantage of developing a strong colour virtually instantaneously on contact with the surface of the CF paper. The colour developed on contact with an acid clay or other inorganic colour developer is normally green if the fluoran ring structure is otherwise unsubstituted, or grey to black if there is a methyl or other lower alkyl group in the 6- position on the fluoran ring (the 3- position in the alternative ring numbering system referred to above). Such fluorans are very widely disclosed in the patent literature, see for example British Patents Nos. 1182743, 1192938, 1269601, 1335762, 1339968, 1374049, 1459417, 1463815, 1478596 and 2002801B, and European Patent Application No. 276980A.

Although 3,7-di-N-substituted fluorans have enjoyed substantial commercial success, they have the drawback that the colour developed fades with time and also changes in hue as it fades, normally becoming redder. In petrochemical-based solvent systems, this problem is not too serious, since it can be compensated for by suitable choice of other chromogenic materials in the blend. However, when these fluorans are used in vegetable oil solvent systems with conventional commercial CF or CFB papers utilizing acid clay or other inorganic colour developers, the initially developed colour is less intense than that obtained in petrochemical-based solvent systems. The intensity after fading has occurred is correspondingly weak, with the result that phthalide/fluoran blends as conventionally used in pressure-sensitive copying paper with petrochemical-based solvents are only just acceptable in solvent systems based on vegetable oils. Furthermore, the problem of a red hue shift on fading remains, and compensation for this by suitable choice of other chromogenic materials in the blend is less straightforward than with petrochemical-based solvents, since the behaviour of these other chromogenic materials is also affected by the use of vegetable oil solvents.

Accordingly, it has proved necessary to consider the inclusion of other types of chromogenic material in the blend in addition, or as an alternative, to the 3,7-di-N-substituted fluorans widely-used hitherto. One such type is the 3,1 benzoxazine class, for example 3,1 benzoxazines of the kind disclosed in U.S. Pat. Nos. 4,835,270 and 4,831,141. These benzoxazines can give rise to a variety of developed colours, depending on the manner in which they are substituted. 2-Phenyl-4-(4-diethylaminophenyl)-4-(4-methoxyphenyl)-6-methyl-7-dimethylamino-4H- benz.3,1 oxazine (and structural isomer(s) thereof) which give a black or near-black hue on colour development and form the subject of Example 17 of U.S. Pat. No. 4,835,270 have been commercialised and are hence of particular interest. These black-developing materials are advantageous in that the developed colour shows no tendency to redden on fading as do the fluorans discussed above. If used in a blend with such fluorans, they therefore counteract the tendency of the image as a whole to become redder on fading. Green-developing benzoxazines of the above-mentioned general class are also of particular interest, since green-developing chromogenic materials are widely used as components of chromogenic material blends intended to give black or near-black images.

We have now discovered that the initial developed colour intensity and the fade behaviour of such 3,1 benzoxazine chromogenic materials as described above in a vegetable oil solvent system can be enhanced, and hence that the aforementioned problems associated with the conventional reliance on 3,7-di-N-substituted fluorans can be mitigated, by applying the colour developer formulation to the base paper at a significantly lower pH than has hitherto been conventional in the manufacture of pressure-sensitive copying materials employing inorganic colour developers. This results in a colour developer surface pH which is also lower than is conventional. We have also observed similar beneficial effects on fade behaviour when using ester solvents as disclosed in our European Patent Application No. 593192A, i.e. mono-, di-, or tri-functional esters of a non-aromatic mono-carboxylic acid having a straight or branched hydrocarbon chain with at least three carbon atoms in the chain (in addition to the carboxyl carbon atom).

The mix formulation pH influences the surface pH of the final colour developer paper, but we have found that appropriate choice of mix formulation is not the only factor to be taken into account in seeking to achieve a desired colour developer surface pH. Different types of base papers give rise to different colour developer surface pH values with the same colour developer mix pH, and even with nominally similar base papers and colour developer formulations, it can be difficult to achieve reproducible colour developer surface pH values. These factors make it expedient to consider colour developer surface pH rather than mix formulation pH when assessing imaging performance, even though mix formulation pH is the primary factor to be taken into account when seeking to achieve a particular desired colour developer pH (it will be appreciated that in view of the factors just discussed, a certain amount of trial and error may be needed to achieve precise desired surface pH levels).

A further complication which arises when assessing colour developer surface pH is that it can change significantly with time, probably as a result of absorption of atmospheric carbon dioxide, acid-transfer from the base paper (in the case of an acid-sized base paper) and the influence of the acid colour developer material which gradually counteracts that of the alkali used to adjust mix pH. It is therefore desirable to consider the colour developer surface pH at the time of use of the paper for copy imaging rather than just the surface pH immediately after manufacture of the paper. Use for copy imaging typically does not occur for some months after the paper has been manufactured, as a result of delays in the distribution chain from manufacturer to paper merchant to business forms printer and of storage of forms before use.

In view of the factors just discussed, it is difficult to determine a precise colour developer surface pH threshold below which benefits are obtained compared with acid clay colour developer papers as commercially available at the priority date hereof. Our measurements show that such papers typically have a surface pH greater than 9 at the time at which they are put on the market, converted into business forms or are used, especially when the base paper used is alkaline-sized rather than acid-sized). We have found that surface pH values below 8.5 give the most benefits, but that some benefit is obtained above this, for example at a surface pH value of up to about 8.7.

Accordingly, the present invention provides pressure-sensitive copying material comprising a sheet support carrying isolated droplets of an oil solution of chromogenic material, said droplets being confined within respective pressure-rupturable barriers, and, on the opposite surface of the same sheet or on a different sheet support, a coating of an inorganic colour developer material effective to develop the colour of the chromogenic materials in said solution on contact therewith, characterized in that:

a) the oil solution comprises, as a solvent, vegetable oil and/or a mono-, di- or tri-functional ester of a non-aromatic mono-carboxylic acid having a straight or branched hydrocarbon chain with at least three carbon atoms in the chain in addition to the carboxyl carbon atom;

b) the solution of chromogenic materials includes at least one 3,1 benzoxazine; and c) the surface pH of the colour developer coating is not more than about 8.7, preferably not more than 8.4 or 8.5.

The pressure-rupturable barrier within which each isolated droplet of chromogenic material solution is confined is typically the wall of a microcapsule, but may be part of a continuous pressure-rupturable matrix as referred to earlier.

We have found that the invention provides good results when the base paper is alkaline- or neutral-sized (typically with alkyl ketene dimer), but a benefit is still to be expected when the base paper is acid-sized (typically rosin-alum sized). It should be understood in this context that the nature of the sizing system used in the base paper influences the surface pH of the colour developer coating to some extent. Thus a conventional acid clay colour developer composition will produce a dry coating of higher surface pH when applied to an alkaline-sized paper than when applied to an acid-sized base paper. So far as we are aware, there had been no commercial use of acid-sized colour developer paper in conjunction with vegetable oil-based chromogenic material solutions at the priority date hereof.

The inorganic colour developer for use in the present invention is typically an acid-washed dioctahedral montmorillonite clay, for example as disclosed in British Patent No. 1213835. Alternatively, or in addition, other acid clays may be used, as can so-called semi-synthetic inorganic developers as disclosed for example, in European Patent Applications Nos. 44645A and 144472A, or alumina/silica colour developers such as disclosed in our European Patent Applications Nos. 42265A, 42266A, 434306A, or 518471A, or as sold under the trademark "Zeocopy" by Zeofinn Oy, of Helsinki, Finland. All of the above-mentioned inorganic colour developers can be used in conjunction with inert or relatively inert extenders such as calcium carbonate, kaolin or aluminium hydroxide.

The vegetable oil for use in the present invention may be a normally liquid oil such as rapeseed oil (RSO), soya bean oil (SBO), sunflower oil (SFO), groundnut oil (GNO), cottonseed oil (CSO), corn oil (CO), safflower oil (SAFO) or olive oil (OLO). However, vegetable oils of a melting point such that they are solid or semi-solid at room temperature (i.e. about 20° to 25° C.) are particularly advantageous, as is disclosed in our European Patent Application No. 573210A. Such solid oils include coconut oil (CNO), palm oil (PO), palm kernel oil (PKO) and hardened vegetable oils such as hardened soya bean oil (HSBO) or hardened coconut oil (HCNO). Blends of more than one of the aforementioned oils may be used, for example a blend of coconut oil and hardened coconut oil or another hardened solid oil.

The solvent may be a blend of vegetable oil and one or more esters as defined above. Such solvent blends are disclosed in our European Patent Application No. 520639A.

The solvent for the chromogenic material solution preferably consists essentially of vegetable oil and/or an ester as defined in the previous paragraph, and is thus substantially free of hydrocarbon or chlorinated hydrocarbon oils as are currently widely used in pressure-sensitive copying papers.

The chromogenic 3,1 benzoxazines for use in the present invention are preferably 2-aryl-4,4-di-aryl 3,1 benzoxazine, with the aryl group in each case preferably being a phenyl group.

A preferred class of such benzoxazines is chromogenic 2-phenyl-4,4-diphenyl 3,1 benzoxazines of the following general formula:

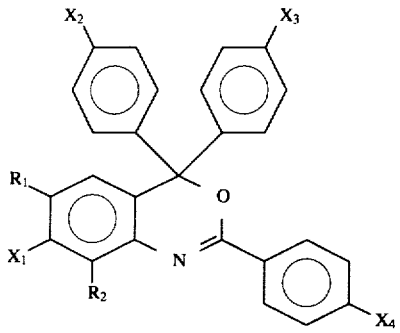

wherein $X_1$, $X_2$, $X_3$ and $X_4$ are the same or different and are each selected from optionally-substituted amino, alkoxy, aralkoxy, aryloxy, hydrogen and halogen and $R_1$ and $R_2$ are the same or different and are each selected from hydrogen, alkyl, aryl or aralkyl, particularly benzyl. For a compound within the general formula above to be chromogenic, it is usually necessary for at least one, and preferably at least two of $X_1$ to $X_4$ to be an alkyl-, aralkyl- or aryl- substituted amino group or an alkoxy, aralkoxy or aryloxy group.

Within the general formula above, the currently most preferred chromogenic compounds are those in which $X_1$ and $X_3$ are dialkylamino; $X_2$ is alkoxy, hydrogen or halogen; $X_4$ is hydrogen or halogen; and one of $R_1$ and $R_2$ is hydrogen and the other is alkyl, particularly lower alkyl such as methyl or ethyl.

Specific examples of 3,1 benzoxazine chromogenic materials suitable for use in the present pressure-sensitive copying material are:

1. 2-phenyl-4-(4-diethylaminophenyl)-4-(4-methoxyphenyl)-6-methyl-7-dimethylamino-4H- benz.3,1 oxazine:

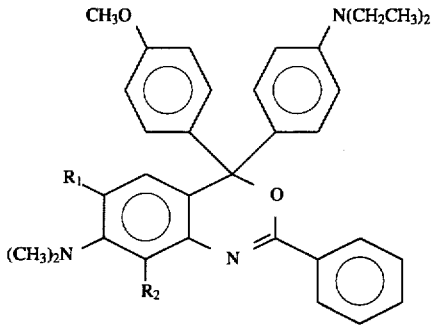

As already mentioned, this compound is the subject of Example 17 of U.S. Pat. No. 4,835,270, and gives a blackish hue on development.

2. 4-(4-diethylaminophenyl)-7-dimethylamino-6-methyl-2-phenyl-4-phenyl-4H-benz.3,1 oxazine:

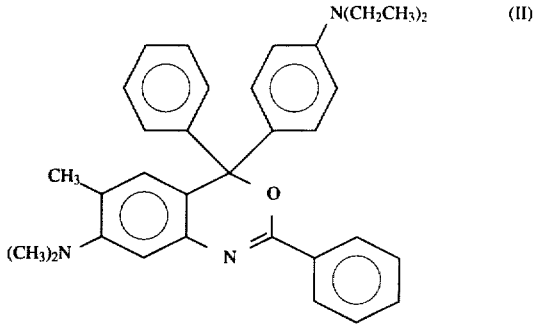

This compound is the subject of Example 18 of U.S. Pat. No. 4,835,270. It gives a green hue on development.

3. 4-(4-chlorophenyl)-4-(4-diethylaminophenyl)-7-dimethylamino-6-methyl-2-phenyl-4H-benz.3,1.oxazine:

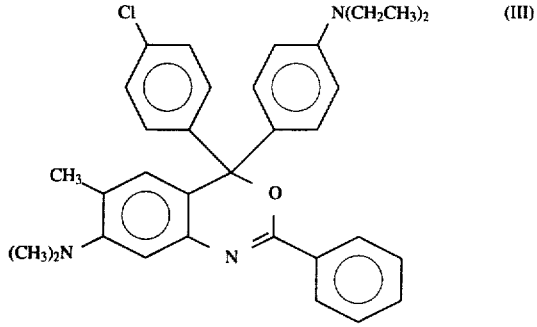

This compound is the subject of Example 16 of U.S. Pat. No. 4,835,270. It gives a green hue on development.

4. 2-(4-chlorophenyl)-4-(4-diethylaminophenyl)-7-dimethylamino-6-methyl-4-phenyl-4H-benz.3,1.oxazine:

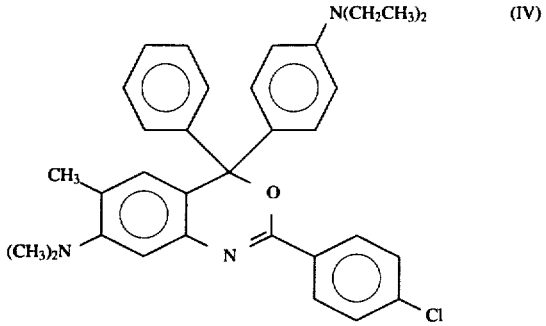

This compound gives a green hue on development.

The above compounds usually contain a minor proportion, say 5 to 15% by weight of an isomer in which the methyl substituent on the benzoxazine ring is the 8- position rather than the 6- position as shown in formulae (I) to (IV).

As mentioned previously, green-developing chromogenic materials are particularly useful in formulating chromogenic material blends which give black or near-black images. Compounds (II), (III) and (IV) above are particularly useful in this respect, since we have observed no noticeable change in hue as the developed image fades. These compounds were also found to give developed images of excellent intensity when applied in vegetable oil solution to acid clay colour developer coatings having a surface pH below 8.7.

The chromogenic material solution used in the present invention typically also includes phthalides such as CVL and 3,3-bis (1-octyl-2-methylindol-3-yl)phthalide and can contain other types of chromogenic material as well, for example 3,7-di-N-substituted fluorans. The combination of a black-developing fluoran with a green-developing 3,1 benzoxazine as described above is of particular interest. Although the black colour derived from the fluoran reddens on fading, the green-developing benzoxazine maintains its original hue, and thus counteracts any tendency of the image as a whole to become redder on fading.

In use, the present solvent composition, containing dissolved chromogenic materials, can be microencapsulated and used in conventional manner.

In addition to the chromogenic materials dissolved in the oil solution, other additives may in principle be present, for example antioxidants to counteract the well known tendency of vegetable oils to deteriorate as a result of oxidation, provided these are compatible with the chromogenic materials and encapsulation process used.

The microcapsules may be produced by coacervation of gelatin and one or more other polymers, e.g. as described in U.S. Pat. Nos. 2,800,457; 2,800,458; or 3,041,289; or by in situ polymerisation of polymer precursor material, e.g. as described in U.S. Pat. Nos. 4,001,140; 4,100,103; 4,105,823 and 4,396,670.

The chromogen-containing microcapsules, once produced, are formulated into a coating composition with a suitable binder, for example starch or a starch/carboxymethylcellulose mixture, and a particulate agent (or "stilt material") for protecting the microcapsules against premature microcapsule rupture. The stilt material may be, for example, wheatstarch particles or ground cellulose fibre floc or a mixture of these. The resulting coating composition is then applied by conventional coating techniques, for example metering roll coating or air knife coating.

Apart from the solvent composition, and the pH of the colour developer coating, the present pressure-sensitive copying paper may be conventional. Such paper is very widely disclosed in the patent and other literature, and so requires only brief further discussion.

The thickness and grammage of the present paper (before microcapsule coating) may be as is conventional for this type of paper, for example the thickness may be about 60 to 90 microns and the grammage about 35 to 50 g $m^{-2}$, or higher, say up to about 100 g $m^{-2}$, or even more. This grammage depends to some extent on whether the final paper is for CB or CFB use. The higher grammages just quoted are normally applicable only to speciality CB papers.

The invention will now be illustrated by the following Examples, in which all parts and percentages are by weight unless otherwise stated.

EXAMPLE 1

Three acid clay colour developer formulations were prepared at different pH values and were each conventionally blade-coated on to conventional alkyl ketene dimer sized 48 g $m^{-2}$ carbonless base paper and dried to give CF sheets. The coatweight applied was 8–9 g $m^{-2}$. Each formulation contained, on a dry basis, 58% acid-washed montmorillonite colour developer clay ("Silton AC" supplied by Mizusawa of Japan), 25% kaolin extender and 17% styrene-butadiene latex binder and was made up at around 47 to 48% solids content. Sodium hydroxide was used for pH adjustment, the amount required being of the order of 2 to 3% depending on the final mix pH desired. The final mix pH values obtained were 10.2, 9.1 and 8.2.

The surface pH of the final CF papers were determined using a pH meter fitted with a surface electrode, and were as set out below:

| Mix pH | Surface pH |
|---|---|
| 8.2 | 8.2 |
| 9.1 | 9.0 |
| 10.2 | 9.7 |

The CF papers were then each incorporated in respective pressure-sensitive copying paper sets with microcapsule-coated CB paper of which the microcapsules contained a 1% solution in 100% CNO of 2-phenyl-4-(4-diethylaminophenyl)-4-(4-methoxyphenyl)-6-methyl-7-dimethylamino-4H-benz.3,1 oxazine i.e. Compound (I) referred to earlier (the 1% concentration figure relates to the compound as prepared including isomers as previously referred to and any minor impurities also present). The microcapsules had been prepared in conventional manner by a coacervation technique as generally disclosed in British Patent No. 870476. The microcapsule wall materials used were gelatin, carboxymethyl cellulose and vinylmethyl ether/maleic anhydride copolymer. Once produced, the microcapsules were formulated into a conventional microcapsule coating composition with a gelatinized starch binder and a particulate starch "stilt material" for preventing accidental rupture of the microcapsule during storage and handling etc. This coating composition was then coated on to a base paper as conventionally used in the manufacture of pressure-sensitive copying paper to produce the CB paper.

Each pressure-sensitive copying paper set was then block-imaged by means of a dot matrix printer, the set was then separated, and the intensity of the block image obtained was determined by measuring the reflectance of the imaged and non-imaged areas by means of a spectrophotometer, and expressing the result as a percentage value, referred to hereafter as the "reflectance ratio" (the lower the reflectance ratio, the more intense the image).

The block image was allowed to develop in the dark for 48 hours in a laboratory drawer before the first measurements were made, in order to ensure that colour development was complete.

The developed image was then exposed for 24 hours in a cabinet in which were an array of daylight fluorescent strip lamps. This is thought to simulate in accelerated form the fading which would be likely to occur under normal conditions of use of imaged pressure-sensitive copying paper. The reflectance measurements were repeated at intervals during the exposure period.

The results obtained are set out in Table 1 below:

TABLE 1

| | Reflectance ratio after stated no. of hours fading | | | | |
|---|---|---|---|---|---|
| CF Surface pH | 0 | 4 | 8 | 16 | 24 |
| 8.2 | 78.8 | 86.5 | 86.7 | 88.5 | 88.8 |
| 9.0 | 79.3 | 89.1 | 89.2 | 89.9 | 90.5 |
| 9.7 | 76.5 | 92.2 | 92.0 | 92.5 | 92.6 |

It will be seen that the lower pH papers (8.2 and 9.0) faded less than the higher pH paper (10.0 and 11.2 difference in reflectance value compared with a 16.1 difference for the pH 9.7 paper). However the initial colour intensity achieved with the higher surface pH paper was a little greater than for the two lower surface pH papers. It was observed that the faded image on the lower surface pH paper showed a more neutral less green hue than the images obtained on the higher surface pH paper.

EXAMPLE 2

Three alumina/silica colour developer formulations were prepared at different pH values (8, 9 and 10) and were each applied to conventional alkyl ketene dimer sized carbonless base paper to produce CF paper. The alumina/silica colour developer was as supplied under the trade mark "Zeocopy 133" by Zeofinn Oy of Helsinki, Finland. Each colour developer formulation contained, on a dry basis, 59.5% silica/alumina, 25.5% kaolin, and 15% latex. The grammage of the base paper was 48 g $m^{-2}$, and the dry colour developer coatweight was 7.5 g $m^{-2}$. Each colour developer formulation was applied at around 48% solids content. Sodium hydroxide was used for pH adjustment, the amount required being of the order of 2 to 3%, depending on the final mix pH required.

The surface pH values of the final CF products were determined as in Example 1 and the results were as set out in Table 2a below:

TABLE 2a

| Mix pH | Surface pH |
|---|---|
| 8.0 | 7.9 |
| 9.0 | 8.3 |
| 10.0 | 9.1 |

The CF papers were then each subjected to Calender Intensity (CI) testing in a pressure-sensitive copying paper couplet (i.e. a CB-CF set) with CB papers carrying encapsulated 1% solutions of chromogenic material as used in Example 1 in a range of solvents. These CB papers were produced generally as described in Example 1 and the solvents were as set out in Table 2b below.

TABLE 2b

| | |
|---|---|
| 100% | sunflower oil (SFO) |
| 50:50 | olive oil (OLO): 2-ethylhexyl cocoate (EHC) |
| 100% | palm kernel oil (PKO) |
| 100% | isopropyl myristate (IPM) |
| 100% | part hardened soyabean oil (HSBO) |
| 50:50 | coconut oil (CNO): hardened (hydrogenated) coconut oil (HCNO) |
| 50:50 | rapeseed oil (RSO): 2-ethylhexyl cocoate (EHC) |

In the CI test, a strip of CB paper is placed on a strip of CF paper, and the strips are passed together through a laboratory calender to rupture the capsules and thereby produce a colour on the CF strip. The reflectance of the thus-coloured strip was measured after 2 minutes and after 48 hours development in the dark (as in Example 1). The result was expressed as an absorbance value by subtracting this measured reflectance from 1.

The developed image was then subjected to fade testing for 16 hours as generally described in Example 1, with further intensity determinations being carried out at intervals.

The results obtained are set out in Table 2c below:

TABLE 2c

| | CF Surface | Absorbance | | Absorbance after fading for: | | |
|---|---|---|---|---|---|---|
| Solvent | pH | 2 min | 48 hr | 4 hr | 8 hr | 16 hr |
| SFO | 7.9 | 0.254 | 0.245 | 0.210 | 0.177 | 0.169 |
| | 8.3 | 0.254 | 0.242 | 0.201 | 0.167 | 0.161 |
| | 9.1 | 0.243 | 0.227 | 0.182 | 0.164 | 0.158 |

TABLE 2c-continued

| | CF Surface | Absorbance | | Absorbance after fading for: | | |
|---|---|---|---|---|---|---|
| Solvent | pH | 2 min | 48 hr | 4 hr | 8 hr | 16 hr |
| OLO/ | 7.9 | 0.238 | 0.236 | 0.216 | 0.181 | 0.168 |
| EHC 1:1 | 8.3 | 0.241 | 0.237 | 0.208 | 0.170 | 0.162 |
| | 9.1 | 0.233 | 0.234 | 0.194 | 0.166 | 0.160 |
| PKO | 7.9 | 0.254 | 0.252 | 0.229 | 0.195 | 0.177 |
| | 8.3 | 0.253 | 0.254 | 0.225 | 0.186 | 0.169 |
| | 9.1 | 0.228 | 0.248 | 0.209 | 0.170 | 0.163 |
| IPM | 7.9 | 0.297 | 0.300 | 0.269 | 0.236 | 0.209 |
| | 8.3 | 0.300 | 0.307 | 0.278 | 0.221 | 0.190 |
| | 9.1 | 0.284 | 0.301 | 0.248 | 0.188 | 0.174 |
| HSBO | 7.9 | 0.251 | 0.251 | 0.222 | 0.189 | 0.174 |
| | 8.3 | 0.252 | 0.254 | 0.219 | 0.180 | 0.166 |
| | 9.1 | 0.236 | 0.250 | 0.198 | 0.172 | 0.164 |
| CNO/ | 7.9 | 0.256 | 0.257 | 0.237 | 0.211 | 0.188 |
| HCNO | 8.3 | 0.256 | 0.260 | 0.232 | 0.195 | 0.174 |
| 1:1 | 9.1 | 0.230 | 0.254 | 0.218 | 0.175 | 0.164 |
| RSO/ | 7.9 | 0.260 | 0.257 | 0.230 | 0.191 | 0.175 |
| EHC 1:1 | 8.3 | 0.262 | 0.261 | 0.224 | 0.178 | 0.166 |
| | 9.1 | 0.252 | 0.259 | 0.194 | 0.168 | 0.161 |

It will be seen that, subject to one or two anomalous or exceptional results, the higher surface pH paper gave less fading than the lower surface pH papers. As in Example 1, the faded image on the lower pH papers showed a more neutral less green hue than on the higher pH paper.

EXAMPLE 3

The acid clay colour developer formulations were prepared by the procedure described in Example 1, except that the final mix pH values and corresponding CF surface pH values were as follows:

| Mix pH | Surface pH |
|---|---|
| 8.0 | 8.4 |
| 8.5 | 8.7 |
| 9.0 | 9.3 |

The CF papers were then each incorporated in respective pressure-sensitive copying paper sets with certain of the microcapsule-coated papers as described in Example 2.

Each pressure-sensitive copying paper set was then block-imaged by means of a dot matrix printer and reflectance measurements were made, all as described in Example 1, except that the accelerated fading exposure measurements were made after 4 and 16 hours, rather than up to 24 hours. The results obtained are set out in Table 3 below:

TABLE 3

| | CF Surface | Reflectance Ratio | | Reflectance ratio after fading for: | |
|---|---|---|---|---|---|
| Solvent | pH | 2 min | 48 hr | 4 hr | 16 hr |
| OLO/EHC | 8.4 | 89.1 | 87.4 | 89.0 | 90.7 |
| 1:1 | 8.7 | 88.7 | 87.0 | 89.8 | 91.8 |
| | 9.3 | 88.0 | 86.2 | 89.8 | 92.9 |
| PKO | 8.4 | 80.6 | 78.6 | 81.7 | 83.8 |
| | 8.7 | 79.4 | 77.1 | 83.9 | 85.0 |
| | 9.3 | 94.5 | 76.8 | 84.8 | 87.7 |
| IPM | 8.4 | 66.5 | 64.4 | 68.2 | 71.9 |
| | 8.7 | 65.4 | 63.4 | 71.1 | 75.5 |
| | 9.3 | 64.5 | 62.6 | 71.6 | 79.5 |
| HSBO | 8.4 | 80.3 | 78.2 | 82.0 | 84.5 |
| | 8.7 | 79.1 | 76.8 | 83.4 | 87.3 |

TABLE 3-continued

| Solvent | CF Surface pH | Reflectance Ratio 2 min | Reflectance Ratio 48 hr | Reflectance ratio after fading for: 4 hr | Reflectance ratio after fading for: 16 hr |
|---|---|---|---|---|---|
| | 9.3 | 78.8 | 76.2 | 83.9 | 89.4 |
| CNO/ | 8.4 | 78.0 | 75.5 | 79.7 | 81.4 |
| HCNO 1:1 | 8.7 | 76.2 | 73.6 | 81.5 | 83.2 |
| | 9.3 | 76.1 | 73.0 | 82.7 | 85.9 |

It will be seen that the resistance to fading was significantly better for the pH 8.4 and pH 8.7 papers than for the pH 9.3 papers. The hue of the faded image was neutral for the pH 8.4 paper, but was greener for the pH 8.7 paper and greener still for the pH 9.3 paper.

EXAMPLE 4

The procedure of Example 3 was repeated except that two different microcapsule-coated papers were used. These contained a 1% solution (including isomers as already referred to and any minor impurities also present) of a further 3,1 benzoxazine green-developing chromogenic material, namely Compound (II) referred to earlier, in 50:50 RSO/EHC and 50:50 CNO/HCNO blends respectively.

The results obtained are set out in Table 4 below.

TABLE 4

| Solvent | CF Surface pH | Reflectance Ratio 2 min | Reflectance Ratio 48 hr | Reflectance ratio after fading for: 4 hr | Reflectance ratio after fading for: 16 hr |
|---|---|---|---|---|---|
| CNO/ | 8.4 | 83.3 | 82.9 | 85.4 | 86.8 |
| HCNO 1:1 | 8.7 | 82.7 | 81.4 | 84.9 | 87.3 |
| | 9.3 | 84.3 | 81.8 | 86.3 | 88.6 |
| RSO/EHC | 8.4 | 90.1 | 89.6 | 91.0 | 92.3 |
| 1:1 | 8.7 | 89.8 | 89.1 | 90.7 | 93.3 |
| | 9.3 | 89.8 | 89.0 | 91.3 | 93.6 |

It will be seen that the resistance to fading was better for the pH 8.4 and pH 8.7 papers than for the pH 9.3 papers although the benefits were not as marked as in the case of the chromogenic material used in Example 3. No hue shift was observed on fading.

EXAMPLE 5

This illustrates the use of two further 3,1 benzoxazine green-developing chromogenic materials, namely Compounds (III) and (IV) referred to earlier. These chromogenic materials were each dissolved in CNO at 1% concentration (including isomers as already referred to and any minor impurities also present). The resulting solution was microencapsulated by the technique referred to in Example 1. The microcapsules obtained were then used to produce CB paper, also as described in Example 1.

These CB papers, together with the CB paper described in Example 1 (containing Compound I) were then block-imaged as described in Example 1 against a range of CF papers. These had been produced by methods similar to those described in Example 1 and had measured surface pH values of 7.3, 7.8, 8.6 and 9.6. The image intensities obtained initially and after fading were determined as described in Example 1, except that measurements were made after only 2 minutes dark development as well as 48 hours dark development.

The results obtained are set out in Tables 5a to 5c below:

TABLE 5a

| CF Surface pH | Compound (III) Reflectance Ratio 2 min | Reflectance Ratio 48 hr | Reflectance ratio after stated no. of hours fading 4 | 8 | 16 | 24 |
|---|---|---|---|---|---|---|
| 7.3 | 88.9 | 89.9 | 91.0 | 92.4 | 93.6 | 95.2 |
| 7.8 | 91.2 | 90.6 | 91.3 | 93.1 | 95.2 | 96.9 |
| 8.6 | 90.0 | 90.5 | 91.2 | 92.2 | 95.1 | 95.7 |
| 9.6 | 94.3 | 93.1 | 92.1 | 92.6 | 96.9 | 97.1 |

TABLE 5b

| CF Surface pH | Compound (IV) Reflectance Ratio 2 min | Reflectance Ratio 48 hr | Reflectance ratio after stated no. of hours fading 4 | 8 | 16 | 24 |
|---|---|---|---|---|---|---|
| 7.3 | 87.7 | 87.6 | 88.7 | 89.6 | 92.4 | 93.0 |
| 7.8 | 89.5 | 88.1 | 88.0 | 90.4 | 93.6 | 94.5 |
| 8.6 | 88.1 | 88.0 | 88.7 | 89.9 | 93.9 | 94.4 |
| 9.6 | 92.5 | 90.1 | 88.9 | 90.3 | 95.5 | 95.7 |

TABLE 5c

| CF Surface pH | Compound (I) Reflectance Ratio 2 min | Reflectance Ratio 48 hr | Reflectance ratio after stated no. of hours fading 4 | 8 | 16 | 24 |
|---|---|---|---|---|---|---|
| 7.3 | 82.2 | 80.8 | 83.9 | 86.5 | 87.0 | 90.6 |
| 7.8 | 81.7 | 80.5 | 83.5 | 87.6 | 89.2 | 93.2 |
| 8.6 | 82.5 | 80.8 | 84.4 | 87.3 | 89.0 | 92.4 |
| 9.6 | 82.8 | 80.7 | 84.1 | 88.2 | 92.0 | 93.9 |

It will be seen that Compounds (III) and (IV), but not Compound (I) gave significantly improved initial image intensity values with the lower surface pH paper (pH values of 7.3, 7.8 and 8.6) than for the paper of higher surface pH. All three compounds showed better image intensity after fading on the lower surface pH papers than on the higher surface pH paper.

For Compounds (III) and (IV), no hue shift was observed on fading for any of the images, whereas for Compound (I), the faded image was less green in hue for the lower pH papers than for the higher pH paper.

We claim:

1. Pressure-sensitive copying material comprising a sheet support carrying isolated droplets of an oil solution of chromogenic material, said droplets being confined within respective pressure-rupturable barriers, and, on the opposite surface of the same sheet or on a different sheet support, a coating of an inorganic colour developer material effective to develop the colour of the chromogenic materials in said solution on contact therewith, wherein:

a) the oil solution comprises, as a solvent, vegetable oil and/or a mono-, di- or tri-functional ester of a non-aromatic mono-carboxylic acid having a straight or branched hydrocarbon chain with at least three carbon atoms in the chain in addition to the carboxyl carbon atom;

b) the solution of chromogenic materials includes at least one 3,1 benzoxazine; and c) the surface pH of the colour developer coating is not more than about 8.7.

2. Pressure-sensitive copying material as claimed in claim 1, wherein the surface pH of the colour developer coating is not more than 8.5.

3. Pressure-sensitive copying material as claimed in claim 2, wherein the surface pH of the color developer coating is not more than 8.4.

4. Pressure-sensitive copying material as claimed in claim 1 wherein the solvent consists essentially of vegetable oil and/or ester(s) as defined in claim 1.

5. Pressure-sensitive copying material as claimed in claim 4, wherein the solvent consists essentially of vegetable oil which is solid or semi-solid at room temperature.

6. Pressure-sensitive copying material as claimed in claim 5 wherein the vegetable oil is coconut oil optionally blended with hardened coconut oil or another hardened vegetable oil.

7. Pressure-sensitive copying material as claimed in claim 1 wherein the 3,1 benzoxazine chromogenic material is a 2-aryl-4,4-diaryl 3,1 benzoxazine.

8. Pressure-sensitive copying material as claimed in claim 7, wherein the benzoxazine chromogenic material is a 2-phenyl-4,4-diphenyl-3,1 benzoxazine.

9. Pressure-sensitive copying material as claimed in claim 8, wherein the chromogenic 3,1 benzoxazine is of the formula:

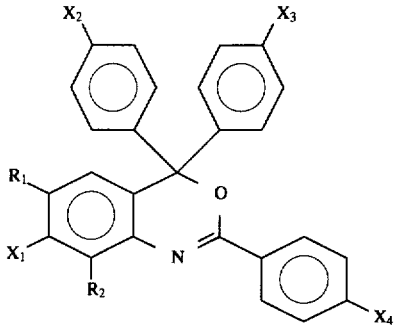

wherein $X_1$, $X_2$, $X_3$ and $X_4$ are the same or different and are each selected from optionally-substituted amino, alkoxy, aralkoxy, aryloxy, hydrogen and halogen and $R_1$ and $R_2$ are the same or different and are each selected from hydrogen, alkyl, aryl or aralkyl, particularly benzyl.

10. Pressure-sensitive copying material as claimed in claim 9, wherein $X_1$ and $X_3$ are dialkylamino; $X_2$ is alkoxy, hydrogen or halogen; $X_4$ is hydrogen or halogen; and one of $R_1$ and $R_2$ is hydrogen and the other is alkyl, particularly lower alkyl such as methyl or ethyl.

11. Pressure sensitive copying material as claimed in claim 10 wherein the chromogenic material is 2-phenyl-4-(4-diethylaminophenyl)-4-(4-methoxyphenyl)-6-methyl-7-dimethylamino-4H-benz.3,1 oxazine.

12. Pressure sensitive copying material as claimed in claim 10 wherein the chromogenic material is 4-(4-diethylaminophenyl)-7-dimethylamino-6-methyl-2-phenyl-4-phenyl-4H-benz.3,1 oxazine; 4-(4-chlorophenyl)-4-(4-diethylaminophenyl)-7-dimethylamino-6-methyl-2-phenyl-4H-benz.3,1 oxazine; or 2-(4-chlorophenyl)-4-(4-diethylaminophenyl)-7-dimethylamino-6-methyl-4-phenyl-4H-benz.3,1 oxazine.

13. Pressure-sensitive copying material as claimed in claim 1 wherein said sheet support is alkaline- or neutral-sized paper.

14. A method for preparing a pressure sensitive copying material according to claim 1, comprising applying the color developer coating to the sheet support, the surface pH of the color developer coating being not more than about 8.7.

15. A method for creating an image, comprising applying imaging pressure to the pressure sensitive copying material of claim 1.

* * * * *